United States Patent [19]

Segol

[11] Patent Number: 4,485,494

[45] Date of Patent: Dec. 4, 1984

[54] GARMENT

[76] Inventor: Avrahaum Segol, 320 West 87th St., New York, N.Y. 10023

[21] Appl. No.: 510,572

[22] Filed: Jul. 5, 1983

[51] Int. Cl.[3] ..... A41B 1/00

[52] U.S. Cl. ..... 2/115; 2/69; 2/74; 2/93

[58] Field of Search ..... 2/69, 93, 94, 102, 105, 2/115, DIG. 7, 114, 74

[56] References Cited

U.S. PATENT DOCUMENTS

| | | | |
|---|---|---|---|
| 2,051,274 | 8/1936 | Rubens | 2/91 |
| 2,157,460 | 5/1936 | Robertson et al. | 2/74 |
| 2,303,536 | 12/1942 | Friedman | 2/74 |

FOREIGN PATENT DOCUMENTS

| | | | |
|---|---|---|---|
| 631292 | 6/1936 | Fed. Rep. of Germany | 2/74 |
| 540517 | 8/1955 | France | 2/74 |
| 470161 | 8/1937 | United Kingdom | 2/93 |

*Primary Examiner*—Werner H. Schroeder
*Attorney, Agent, or Firm*—Lackenbach, Siegel, Marzullo, Presta & Aronson

[57] ABSTRACT

A garment is formed with a body encircling portion which encircles and encloses the body, either temporarily or permanently, for about one-third or less the length of the garment, with two-thirds or more of the garment being open, and yet the garment gives the appearance of being fully closed along the sides or located areas of open section. The garment is formed with at least four distinct corners which may contain fringes. A novel bag or encasement for laundering the fringes is also provided. This garment is particularly designed and suited as a Jewish religious garment known as a "4-cornered garment" with "tzitzioth", wherein the observant requirements of the garment are provided for and yet the garment has the appearance and usefulness of unique and contemporary garment.

10 Claims, 5 Drawing Figures

FIG. 1
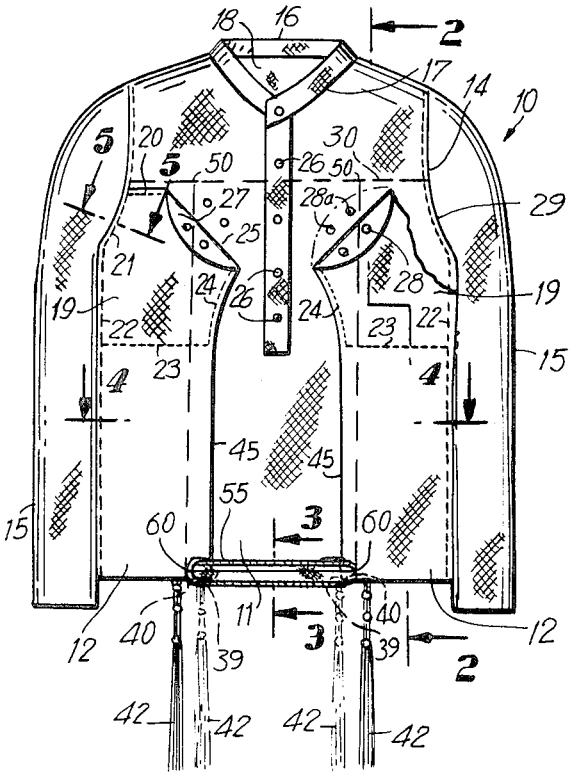
FIG. 5
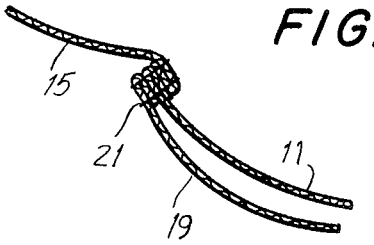
FIG. 2
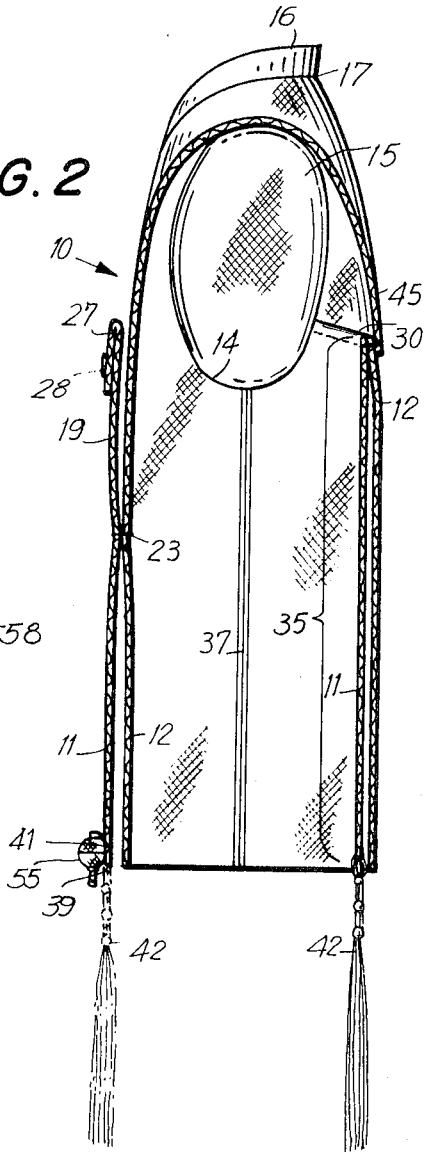
FIG. 3
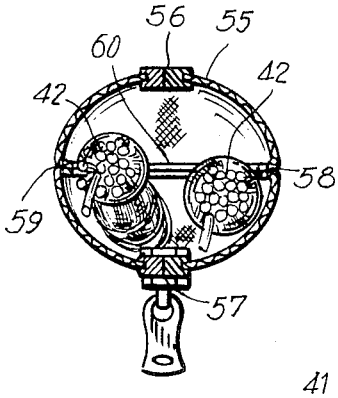
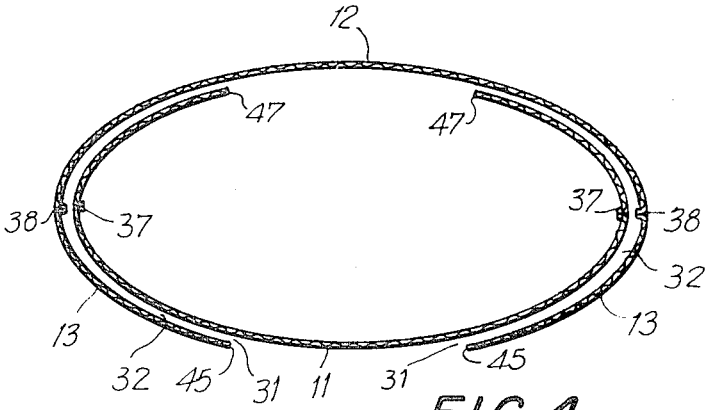
FIG. 4

GARMENT

FIELD OF THE INVENTION

This invention relates to garments. In one specific aspect this invention relates to a tzitzioth garment construction.

BACKGROUND AND DISCUSSION OF THE PRIOR ART

Heretofore in the general garment art, it was known to provide garments with noticeable side and back vents as disclosed in U.S. Pat. No. Des. 21,504, granted May 24, 1892 to Young, as well as jackets with bottom fringes as disclosed in U.S. Pat. No. Des. 232,603, granted Sept. 3, 1974, to Morgan.

In Jewish religious law, or Halakah, observant Jews, since the time of Moses, are required to wear a "four cornered garment" with a specially braided fringe (tzitzioth) attached to each corner. This is considered a deed or "Mitzvah" performed in adherence to the Laws of Torah (Five Books of Moses) where in observance calls for the children of Israel to attach tzitzioth ". . . to the four corners of your garments . . . ".

Most traditionally this 4-cornered tzitzioth garment has been constructed from a simple 4-cornered acceptable piece of material with an ample circle cut out in center as a hole through which the wearer's head may pass, thus allowing the full portion of material to simply drape down, falling against the wearer's body when the garment is placed on as clothing. The garment is fully open along all sides, with the tzitzioth having been appropriately attached before the garment is worn.

The "4-cornered" tzitzioth garment has most commonly been worn as an undergarment. This 4-cornered garment most traditionally has been worn by men, although some observant women have also worn tzitzioth. The four-cornered tzitzioth garment has undergone very little in the way of basic construction change over many years, perhaps centuries.

For various reasons, social or otherwise, modern day activity has exempted the choice of a major portion of the Jewish population to wear the traditional 4-cornered tzitzioth garment. Though seen as serving an observant function to the Laws of Torah, the traditional garment has been put aside either as not being considered commonly needed in this "day and age", or as being uncomfortably cumbersome and "aesthetically undesirable." As an example, in all sorts of weather, winter and summer alike, an observant member of Israel commonly wears an undershirt and a traditional woolen tzitzioth garment over which both a conventional shirt and suit of choice is most normally added. This is especially uncomfortable in the summer months and in warm climates.

Now there is provided by the present invention a novel tzitzioth garment which has the requisite observant requirement features to adhere to the learnings of Torah and yet provides a uniquely different garment of aesthetically desirable and contemporary appearance.

Specifically, the garment of the present invention is at least about two-thirds opened, in this example at the sides, but gives the appearance of fully encircling the wearer's body at the located areas of opening.

Another present day problem with the tzitzioth garment, is that mechanical laundering damages the very specific requisite braiding of the fringes (tzitzioth). Traditionally, once the tzitzioth braiding is damaged, they require changing or the entire garment is considered not correctly useful; often then the entire garment is disposed of. Thus laundering has been necessarily done gently by hand to extend the life-expectancy of the tzitzioth and very inconvenient to wash the garment itself. The present invention also provides for protective laundering of the tzitzioth.

It is therefore a principal object of the present invention to provide a garment with generally open construction and yet the appearance of being body encircling.

It is another object of the present invention to provide a garment as aforesaid, which is a tzitzioth garment.

It is still another object of the present invention to provide a tzitzioth garment as aforesaid which has the aesthetic acceptability of a contemporary shirt or outerwear.

It is still a further object of the present invention to provide a bag for the protective laundering of the tzitzioth.

It is still a further object of the present invention to provide the combination of a tzitzioth garment and tzitzioth laundering bag.

Another object of the present invention is to provide a garment which may be readily manufactured, of contemporary appearance, and yet practical in wide everyday use by the wearer.

BRIEF DESCRIPTION OF THE DRAWINGS

FIG. 1 is a front elevational and partial fragmentary view of the garment of the present invention;

FIG. 2 is a sectional view taken along line 2—2 of FIG. 1;

FIG. 3 is a sectional view taken along line 3—3 of FIG. 1;

FIG. 4 is a sectional view taken along line 4—4 of FIG. 1; and

FIG. 5 is a partial sectional view taken along line 5—5 of FIG. 1.

BRIEF SUMMARY OF THE INVENTION

A garment is provided with at least four-corners, in this preferred embodiment a four bottom-cornered construction, which is about two-thirds opened at the sides and yet has the appearance of being fully body encircling at the sides. The garment construction is particularly suited as a tzitzioth garment.

A bag is provided for use with a tzitzioth garment, separately or attached, for the protective laundering of the tzitzioth, particularly so without the need for removing the tzitzioth.

DESCRIPTION OF THE PREFERRED EMBODIMENTS

Referring to the Figures there is shown the garment of the present invention generally referred to as 10. Garment 10 is formed of a front piece 11 and back piece 12 with the back piece overlying the front piece as at 13, as will be discussed more fully hereinafter. The front piece 11 and back piece 12 form a sleeve hole rim or hem 14 to which sleeves 15 are stitched and attached. A collar 16 is stitched at 17 at the top 18 of garment 10, which collar 16 is provided with buttons 26 of conventional design. Pockets 19 are formed from back piece 12 also stitched to front 11 and back 12 as at portions 20, 21, 22, 23, and 24 so as to provide slant openings 25. Pockets 19 are also formed with flaps 27 and button sets 28 and 28*a*, for respectively opening and closing (broken line view) the pockets.

Back piece 12 is stitched to front piece 11 as at pocket portion 23, pocket portion 22, portion 21 and shoulder portion 30, to provide front edge 45 forming front openings 31, which extend at 32 around the inside of garment 10. Front piece 11 is formed with rearwardly disposed opposing free edges 47. Thus, the garment when viewed from the front or back appears to be a conventional closed garment but is in fact, formed to be open as at 31 extending into 32. This opening 32 is approximately ⅔ along the length of the garment at about the sides and back as shown at 35 (FIG. 2). Note also that front piece 11 is actually formed of two portions stitched at 37 and back piece 12 is formed of two portions stitched at 38.

Back piece 12 forms two forwardly disposed bottom corners 39, whereas front piece 11 forms two rearwardly disposed bottom corners 40 (see broken line FIG. 1). Corners 39 and 40 are formed with holes 41 for attaching tzitzioth 42 according to Halakah. At corner 39 front edge 45 is free (unstitched) until forming the stitched pocket edge 24. Rearward edges 47 extend freely upwardly until being stitched to shoulder piece 49 as at 50 (FIG. 1).

It is believed that the bottom corner construction, the tzitzioth and the approximate ⅔ or more opened construction as shown meets the requirements of the Halakah, and the garment is thus suitable for use by observant Jews.

In another embodiment, garment 10 is provided with an elongated bag 55 which may be formed of sufficiently wide zipper tape, water proofed or porous laundry bag material, which bag 55 is formed with top and bottom zippers 56, 57 respectively or double headed single zipper opening from opposing sides on one side of the bag, as well as only a single line of Velcro tape. The zippers 56 and 57 are designed to open and close in opposite directions. Aside from the zippered openings, the bag 55 is stitched closed as at 58 and 59 as well as at the ends 60. In this manner of construction, one tzitzioth 42 may be placed in bag 55 through the opening of the zipper 56 and the zipper 56 closed thereafter enclosing it to the corner part of its attachment, while another tzitzioth 42 may be placed in bag 55 through the opening of zipper 57 and closed therein, so that there are tzitzioth in the closed laundry bag at any one time, as best shown in FIGS. 1 and 3. Note that the number of tzitzioth to be placed in laundry bags is determined by thickness of the tzitzioth material and desire of user (i.e. from 1 per bag to all four in 1 bag). Note that FIG. 1 shows the front piece tzitzioth in phantom line inasmuch as the tzitzioth are within bag 55 (see also FIG. 3).

In this manner of construction, the bag enclosed tzitzioth may be machine laundered without damage to the braiding of the tzitzioth. It is also within the contemplation of the present invention to povide Velcro attachments (not shown) on bag 55, as well as on the inside of garment 10 attached so that the bag or bags can be stored or permanently attached to the garment itself during wearing of the garment. It is also contemplated that the tzitzioth themselves may be made detachable and removable from the respective corners and placed in the bag and laundered separately from the garment. And the bag or encasement may be integrally and permanently formed with the garment. It is also to be noted that Velcro closures may be used in lieu of zippers.

The garment may be made of any conventional garment material but preferrably of readily laundered material such as wool, linen, cotton, cotton-synthetic composites and the like. While the garment has been shown as a shirt, other garments according to the present teaching are contemplated including, style designed reversible jackets, sweaters, suit coats, hospital wear, gowns, dresses, outerwear and the like, appropriately designed for both men and women. Belted garments are also contemplated.

Thus, there has been described a garment which provides a novel opened construction and yet gives the appearance of a fully enclosed garment, and is also specifically adaptable as a tzizioth garment.

It will be understood that the embodiment of the present invention which has been described is merely illustrative of one of the applications of the principles of the invention. Numerous style modifications may be made by those skilled in the art without departing from the true spirit and scope of the invention.

What is claimed is:

1. A garment comprising:

a torso front piece;

a torso back piece encircling a portion of the front piece; and said pieces being stitched so that the upper portions of the pieces fully encircle the upper torso and wherein the pieces are opened at about the sides for about ⅔ the length of the sides with the back piece being provided with two free edges at the outside front of the garment and the front piece being provided with two free edges at the rear portion of the garment, whereby the garment when worn on the torso of the user gives the appearance of being closed.

2. The garment of claim 1, said being formed with four corners.

3. The garment of claim 2, said corners being formed with means to attach fringes to the corners.

4. The garment of claim 3, said fringes being tzitzioth.

5. The garment of claim 1, said garment further comprising sleeves.

6. The garment of claim 5, further comprising a collar being formed with the front and back portions.

7. A Jewish religious garment comprising;

an upper torso front piece;

an upper torso back piece encircling a portion of the front piece; and said pieces being stitched so that the back piece is provided with two free edges at the outside front of the garment and the front piece is provided with two free edges at rear portion of the garment, wherein the front and back pieces are opened at about the sides for about ⅔ of the length of the sides, said respective free edges being formed with respective bottom corners, each of said corners further comprising means to attach fringes, and fringes being attached to said corners, said fringes being tzitzioth, said laundering means comprising an elongated tubular bag having means to open and close the bag, said bag being formed to receive said attached fringes of the garment when the bag is opened, and the bag is closed with the fringes therein for laundering of the fringes without damage to the fringes.

8. The garment of claim 7, said front and back forming edges forming sleeve holes and said pieces being stitched at the sleeve edges.

9. The garment of claim 8, wherein the pieces are stitchedly formed at the front to provide pockets.

10. The garment of claim 7 further comprising a means for laundering the fringes, said laundering means comprising an elongated tubular bag having means to open and close the bag said fringes being enclosed in said bag which is connected to said garment for laundering the fringes without damage to said fringes.

* * * * *